US010925400B2

(12) United States Patent
Cunnah et al.

(10) Patent No.: US 10,925,400 B2
(45) Date of Patent: Feb. 23, 2021

(54) FLEXIBLE CROWD SEATING

(71) Applicants: Michael Cunnah, Maidenhead (GB); Noel Jeffs, Wiltshire (GB)

(72) Inventors: Michael Cunnah, Maidenhead (GB); Noel Jeffs, Wiltshire (GB)

(73) Assignees: Michael Cunnah, Berkshire (GB); Noel Jeff, Wiltshire (GB)

( * ) Notice: Subject to any disclaimer, the term of this patent is extended or adjusted under 35 U.S.C. 154(b) by 0 days.

(21) Appl. No.: 16/462,619

(22) PCT Filed: Nov. 28, 2017

(86) PCT No.: PCT/GB2017/053567
§ 371 (c)(1),
(2) Date: May 21, 2019

(87) PCT Pub. No.: WO2018/100347
PCT Pub. Date: Jun. 7, 2018

(65) Prior Publication Data

US 2019/0298063 A1 Oct. 3, 2019

(30) Foreign Application Priority Data

Nov. 29, 2016 (GB) ..... 1620239.2
Aug. 30, 2017 (GB) ..... 1713870.2

(51) Int. Cl.
*A47C 1/121* (2006.01)
*A61G 5/12* (2006.01)
*A47C 7/56* (2006.01)

(52) U.S. Cl.
CPC ..... *A47C 1/121* (2013.01); *A61G 5/128* (2016.11); *A47C 7/56* (2013.01); *A47C 7/563* (2013.01); *A47C 7/566* (2013.01)

(58) Field of Classification Search
CPC ..... A47C 1/121; A47C 7/56; A61G 5/128; B64D 11/06; B64D 11/638
(Continued)

(56) References Cited

U.S. PATENT DOCUMENTS 975,973 A * 11/1910 Martin ..... B60N 2/305 297/335
1,358,194 A * 11/1920 Fune ..... A47C 7/56 297/333
(Continued)

FOREIGN PATENT DOCUMENTS

CN 103829629 6/2014
DE 201 09 280 8/2001
(Continued)

OTHER PUBLICATIONS

International Search Report for PCT/GB2017/053567 dated Jan. 18, 2018, 2 pages.

*Primary Examiner* — Syed A Islam
(74) *Attorney, Agent, or Firm* — Nixon & Vanderhye P.C.

(57) ABSTRACT

A seat unit (4) for use in a stepped seating venue comprises a rear frame (11) having a fixed back support (17), a fold away seat pan (21) pivotally mounted with respect to the rear frame (11) on a pair of seat pan pivots (23) and forward of the rear frame (11) when in use. The seat pan (21) folds against the rear frame (11) when not in use. A second frame (25) to support feet is also pivotally mounted on frame (11) below the seat pan pivots (23). The second frame (25) moves in tandem with the seat pan (21) from an open position substantially parallel to the seat pan (21) when the seat pan is in use to a position against the rear frame (11) when the seat pan (21) is not in use.

13 Claims, 13 Drawing Sheets

(58) Field of Classification Search
USPC ..... 297/335
See application file for complete search history.

(56) References Cited

U.S. PATENT DOCUMENTS

| | | | | | |
|---|---|---|---|---|---|
| 2,652,881 | A * | 9/1953 | Rowe | A47C 7/56 | 297/332 |
| 2,685,325 | A * | 8/1954 | Webster | A61G 5/14 | 297/30 |
| 3,025,101 | A | 3/1962 | McKinnie | | |
| 3,850,476 | A * | 11/1974 | Day | A47C 1/121 | 297/335 |
| 4,519,646 | A * | 5/1985 | Leitermann | B60N 2/3013 | 296/65.09 |
| 5,328,239 | A * | 7/1994 | Yamazaki | A47C 7/56 | 297/333 |
| 5,899,531 | A * | 5/1999 | Koehler | A47C 1/121 | 297/331 |
| 6,293,621 | B1 * | 9/2001 | Marsh | A47C 1/121 | 297/248 |
| 6,481,789 | B1 * | 11/2002 | Ambasz | A47C 1/121 | 297/332 |
| 6,843,500 | B2 * | 1/2005 | Li | A61G 5/08 | 280/250.1 |
| 7,484,804 | B2 * | 2/2009 | Clauss | A47C 1/121 | 297/14 |
| 8,998,313 | B2 * | 4/2015 | Reh | B64D 11/06 | 297/188.1 |
| 9,102,409 | B2 * | 8/2015 | Weil | B60N 2/305 | |
| 9,693,631 | B2 * | 7/2017 | Jacobs | A47C 1/126 | |
| 9,844,270 | B2 * | 12/2017 | Windsor | A47C 1/121 | |
| 2004/0232744 | A1 | 11/2004 | Suprina | | |
| 2007/0052263 | A1 * | 3/2007 | Baumann | B64D 11/0638 | 297/146 |
| 2008/0203775 | A1 | 8/2008 | Caroen et al. | | |
| 2012/0086252 | A1 | 4/2012 | Hong | | |
| 2012/0280194 | A1 * | 11/2012 | Stanojevic | A47C 7/56 | 256/26 |
| 2013/0016540 | A1 | 1/2013 | Barauna | | |
| 2015/0042138 | A1 * | 2/2015 | Agdas | A47C 11/00 | 297/335 |

FOREIGN PATENT DOCUMENTS

| | | |
|---|---|---|
| DE | 20 2009 00147 | 5/2009 |
| DE | 10 2009 05652 | 6/2011 |
| DE | 10 2011 11926 | 5/2013 |
| DE | 20 2015 00320 | 8/2015 |
| EP | 3090657 | 11/2016 |
| WO | 03/015584 | 2/2003 |

* cited by examiner

FLEXIBLE CROWD SEATING

This application is the U.S. national phase of International Application No. PCT/GB2017/053567 filed Nov. 28, 2017 which designated the U.S. and claims priority to GB Patent Application No. 1620239.2 filed Nov. 29, 2016 and GB Patent Application No. 1713870.2 filed Aug. 30, 2017, the entire contents of each of which are hereby incorporated by reference.

TECHNICAL FIELD

This invention relates to seating used in arenas and venues, such as sports stadia, concert venues, and theatres capable of holding significant numbers of people.

BACKGROUND ART

As a result of past incidents as a result of crowd surges etc., authorities in many parts of the world have imposed regulations requiring sports and entertainment venues with tiered terracing, such as football grounds to be all seated. Unfortunately, this has not entirely eliminated standing within the seated areas either as a result of spectators standing when excited to get a better view of the action taking place, as a result of deliberate intransigence from spectators resisting the move to all seated stadia or as a result of obstructed views caused by permanent or temporary structures such as barriers, advertising boards etc. When spectators stand, other seated spectators behind those standing either stand too, or become agitated with those who are blocking their view, none of which is desired. As guard rails are not normally provided in seated accommodation there is a risk of spectators falling from height over low barriers below the regulatory (in the United Kingdom) 1.1 m in height, seat backs etc. or toppling forward and falling on top of other spectators, when they stand.

Spectators dancing in seated accommodation during concerts present significant risks of falling from height over low barriers or over seat backs. The health and safety risks of falling from height or toppling forward whilst persistently standing or dancing are significantly increased when spectators have consumed alcohol.

Persistent standing is also a customer service issue as it impacts spectator comfort, amenity and event/match day experience.

DISCLOSURE OF INVENTION

According to the present invention a seat unit for use in a seating venue comprises:

- a rear frame comprising two spaced apart members having a fixed back support mounted thereon;
- a fold away seat pan pivotally mounted with respect to the rear frame on a pair of seat pan pivots, said seat pan extending substantially forward of the rear frame when ready for use but vertical adjacent the rear frame when not in use;
- a footrest pivotally mounted on footrest pivots below the seat pan pivots, the footrest moving in tandem with the seat pan from an open position substantially parallel to the seat pan when the seat pan is in use to a vertical position against the rear frame when the seat pan is not in use; and
- two side frames, one each side of side the seat pan.

The side frames are normally arranged to restrict sideways movement of a spectator standing in the space of the seat pan when the seat pan is vertical.

In most cases the seat unit would include a guardrail or transverse barrier member between the spaced apart members, said transverse barrier member being above and behind the back support. However, in some situations, for example where the seat unit is installed for example where there is a low risk of persistent standing occurring, immediately in front of a wall or in other situations where a person will not stand or pass behind the seat unit, this can be omitted.

Although specifically designed for stepped seating venues the invention can be used in flat venues, where spectators or audiences could sit or stand times as it leads to increased safety and improved line of sight.

For most locations the height of the top of transverse barrier member, when installed on step or floor of the venue, is best set 1.1 metres above the top of a step or above the floor in a flat venue. However this could vary between 0.8 metres and 1.3 metres depending on the location of the venue and the average height of attendees at the venue.

The present invention seeks to create a safe environment that meets stadia and statutory building regulations and health and safety recommendations for able bodied adults, children, semi-ambulant, and ambulant disabled spectators, workers etc., thus reducing the safety risks associated with spectators persistently standing or dancing in tiered stands and its adverse impact on the quality of spectator viewing accommodation to an acceptable level to comply with safety and security authority regulations.

In order to facilitate use by more disabled persons, in a row of seat units according to the invention, one or more seats units may be provided with a retractable seat pan pivotally mounted on a frame wherein height of the seat pan, when in use, is at the same height as the seat pan of an adjacent seat unit according to the invention, but no footrest is provided. In such a case, optionally a raised platform is provided below the retractable seat pan at the height of a footrest, when in use, of a set unit according to the invention.

The invention should also improve the safety and welfare of workers in venues who are at risk in areas in venues where there are no are guard rails or safety barriers, or the rails or barriers are insufficiently high to protect them from harm through falling, undue crowd pressures etc. when attending incidents or on non-event days when carrying out maintenance, cleaning duties and the like.

The seat pan is normally mounted on a seat pan frame. In one arrangement one or more linkage arms connect of the seat pan mounting frame and footrest to ensure that they operate in tandem.

In such an arrangement a counter weight bar may be located at the rear of the seat.

In one arrangement the counterweight is connected to linkage arms, the counterweight and linkage arms acting together to ensure that the seat pan and footrest automatically tip up to their vertical position when the seat pan is not in use.

In another arrangement cables, wires or coil springs join the seat frame and footrest, with the counterweight tending to pull the seat and footrest to a vertical position when the seat is not in use.

In a further arrangement, coils springs may be located around the seat pan pivots or foot pan pivots, connected at one end to the seat frame or foot rest and at the other end to fixed points, the coil springs biasing the seat pan and footrest to the vertical position when the seat pan is not in use.

The side frames act as support legs and arm rests also provides containment for a spectator standing in the space occupied by the seat pan when it is not in use, restricting to a degree the sideways movement of that spectator.

The footrest is used as an aid to mount and dismount and as a foot support when the seat pan is in use.

Fixing plates are fixed to the end of the rear frame and side frames allowing the complete seat unit to be bolted onto a step's tread. Fixing plates may alternatively be fitted to the rear frame to enable the seat unit to be bolted to the step's riser.

It is preferred, where possible, that seat units are arranged in rows on the steps wherein a row is off-set behind the row in front by half the width of a seat unit.

Infill frames each being half the width of a seat unit are provided at both ends of the off-set row and comprise a secondary leg which also acts as a hand hold adjacent to the radial gangway.

As the seat pan height of seating units according to the invention is higher than the seat pan height of conventional retractable seating, in some venues it may be possible to have a floor for the front row that is lower than in conventional venues, with tiers behind similarly lower. Where this is practicable, say when the front row would be seated, then there is considerable savings in construction costs for the venue, though use the reduced total height of the tiers.

BRIEF DESCRIPTION OF DRAWINGS

In order that the invention may be more fully understood, one example is described with reference to the accompanying drawings in which.

BEST MODE FOR CARRYING OUT THE INVENTION

Figure 1:
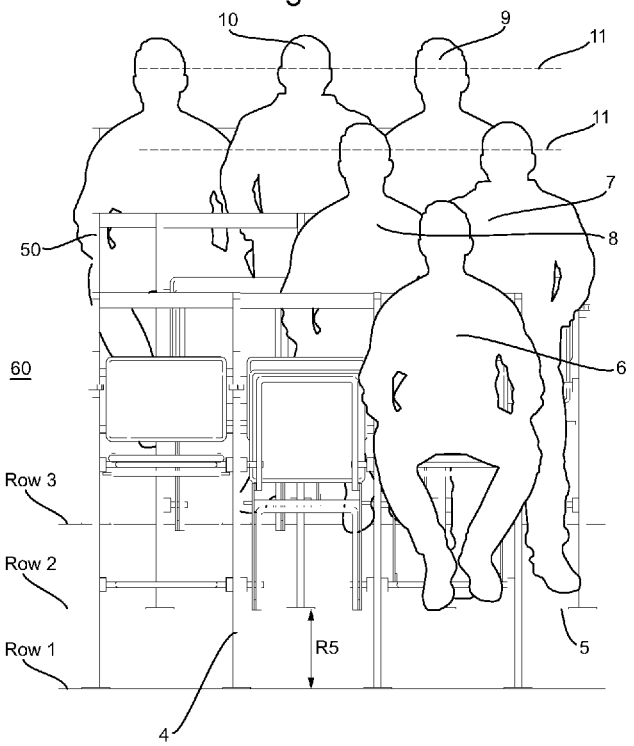
FIG. 1 shows one example of the invention, and is a front elevation of a part of a tiered section of a stadium or any other sports or entertainment venue showing rows of seat units according to the invention.
Figure 2:
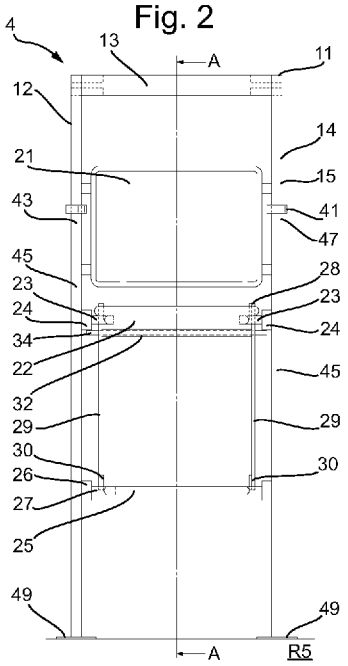
FIG. 2 shows a front view of an individual seating unit as shown in FIG. 1 with its the seat pan and footrest horizontal as in use, according to the invention.
Figure 3:
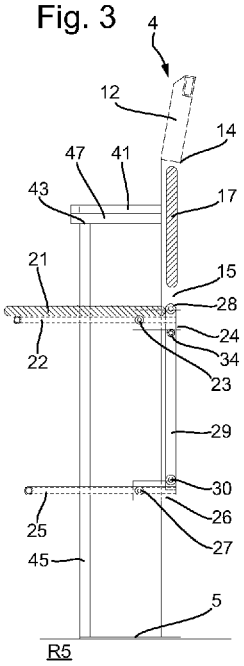
FIG. 3 shows a side elevation on the line AA of FIG. 2.
Figure 4:
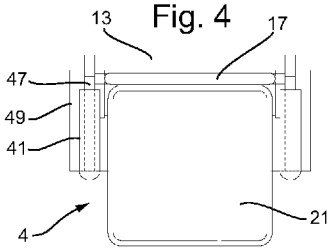
FIG. 4 shows a plan view of the seat unit of FIGS. 2 and 3 with the seat pan and footrest horizontal as in use.

In FIG. 1 shows a number of exemplary seat units 4 according to the invention mounted on the flat steps 5 of Rows 1, 2 and 3, with step risers R5, at a venue. The seat units are arranged in rows (three are shown Row 1, a Row behind 2 and a further Row 3 behind that. Normally the venue will contain multiple rows. There are some seated spectators 6, 8, 9 and other standing spectators 7, 10. As can be seen in FIG. 1 the construction of the seat units is such as to bring the sightline heights 11 of both the seated spectators 6, 8, 9 and the standing spectators 7, 10 roughly into alignment in each row.

The seat units in Row 2 are off-set to those in Rows 1 and 3, a sequence that is repeated in the rows behind, which significantly improves the quality of the viewing standard, for example, of Spectator 9 who looks between the heads, rather than over the heads, of spectators 7 and 8 in Row 2 who are immediately in front.

The off set of seat units with an infill frame 50 in alternate rows also improves the quality of spectator 9 sightline over the head of spectator 6 located two rows in front looking towards a focal point which in the case of football and rugby events is either one of the touch or goal lines. This sightline is known as the C Value and is illustrated more clearly in FIG. 11. The off-set is shown in FIG. 1 with the seating units 4 in Row 2 being off-set by half their width with respect to the Rows 1 and 3.

The viewing experience of spectators in rows other than the front row is substantially improved. The front row view could be improved if there are barriers, advertising boards etc. that may restrict spectators views In FIG. 1 the off-set in Row 2 would cause a gap of half the width of a seat at the end of the row adjacent to the normal radial gangways 60 in tiered seating venues. This gap is filled using an infill frame 50, which can also provide a hand grip for spectators moving up and down the gangway 60 concerned.

FIGS. 2 to 7 show the general construction of exemplary seat units 4 according to the invention. The seat unit 4 has a rear frame 11 having spaced apart side members 15. A fixed back support 17 is mounted on each of the side members 15 the rear frame 11.

A guardrail or transverse barrier member 13 is fixed between the side members 15 of the rear frame 11 with the top of the transverse barrier member 13 at a height of above the top the riser R5 (see FIG. 1) of the row behind the seat to prevent spectators in the row behind falling forward on top of other spectators in front. As the heights of risers R5 may vary, the overall height of the barrier member 13 from the top of the step may vary to suit the venue, but would be 1.1 m plus the height of the riser R5 concerned for many applications (or as set by local regulation), in the range 800 mm to 1300 mm depending on the venue, its location, and the average height of attendees at the venue.

The barrier member 13 and side members 15 can be made from one piece of bent tube, or bolted or welded together. A seat pan 21 is mounted on a seat pan frame 22 which is pivotally mounted with respect to the rear frame 11. The seat pan 21 and seat pan frame extend horizontally from the rear frame 11 when the seat pan is in use (as in FIGS. 2 to 4) but rotate to a vertical position adjacent the back support 17 and rear frame 11 when not in use as in FIGS. 5 to 7. The position of the back support 17 mounting on the rear frame is such that the back support 17 will generally support the back of a spectator sitting on the seat pan 21.

A rearward directed bend or crank 14 is provided in the side frames 15 towards their tops to ensure that the barrier 13 is clear of the head of any person seated on the seat pan 21.

A footrest 25 is pivotally mounted with respect to the rear frame 11 and below the seat pan 21. A pair of linkage arms 29 are pivotally mounted with respect to the seat pan frame 22 and link the seat pan mounting frame 22 to the footrest 25. They linkage arms are also pivotally mounted on the footrest 25. As result the seat pan 21 and footrest 25 rotate in tandem, with the footrest 25 being horizontal when the seat pan 21 is horizontal, and is folded away vertically when the seat pan is folded away vertically.

Figure 5:
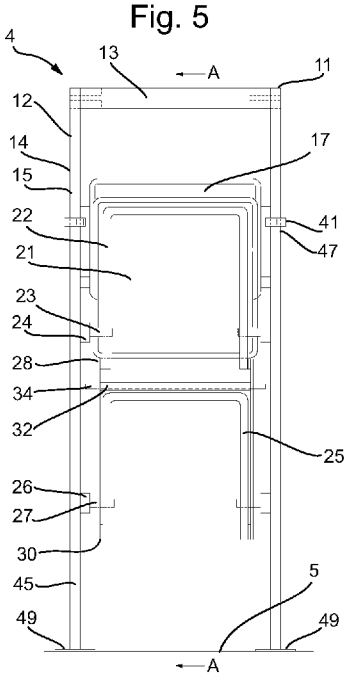
FIG. 5 shows a front view of the individual seating unit of FIGS. 2 to 4 but with the seat pan and footrest folded back against the rear frame allowing a spectator to stand in the space previously occupied by the seat pan.
Figure 6:
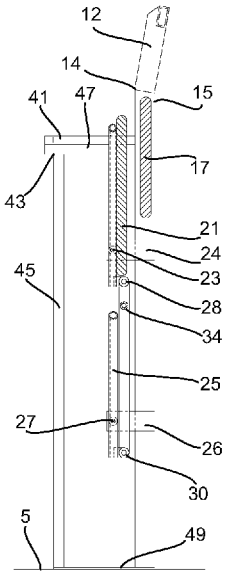
FIG. 6 shows a section on the line BB of the seating unit of FIG. 5 with the seat pan and footrest folded back against the rear frame allowing a spectator to stand in the space previously occupied by the seat pan and footrest.
Figure 7:
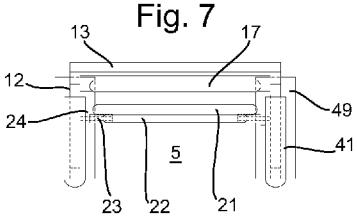
FIG. 7 shows a plan view of the seating unit of FIGS. 5 and 6 with the seat pan and footrest folded back against the rear frame allowing a spectator to stand in the space previously occupied by the seat pan and footrest.

The seat pan 21 is mounted on a square seat pan frame 22 with rounded corners. Seat pan pivots 23 pass into the frame 22. The seat pan pivots 23 themselves are mounted in seat pan frame pivot blocks 24 one each extending forwards one from each side of the side members 15 of rear frame 11. The seat pan 21 will thus extends forwards horizontally from the rear frame 11 when the seat pan 21 is to be used (FIGS. 2 to 4) but will pivot into a vertical position adjacent the rear frame 11 when out of use (FIGS. 5 to 7). A counter weight 32 is added to the weight of the seat pan, seat pan frame and footrest extends between the linkage arms and has lateral extensions in the form of lugs 34 passing through the linkage arms which engage against the underside of the seat frame pivot blocks 24 to prevent over-rotation of the seat pan, seat frame and footrest. The lugs 34 also support the counter weight 32 in the seat pan frame. A footrest 25 is mounted on a pair of opposed footrest pivots 27 mounted in footrest pivot blocks 26 on the side members 15 and below the seat pan frame pivot blocks 24.

In the drawings, although linkage arms 29 are shown, these can be replaced by cables or coil springs in the embodiments shown, as the counterweight will return the seat pan and foot rest to the vertical position when the seat is not being sat on.

Linkage arms 29 are pivotally mounted on pivots 28 on opposite sides of the rear of seat pan frame 22 and on pivots 30 on opposite sides of the footrest 25 towards its rear. The linkage arms 29 ensure that the seat pan 21 and the footrest 25 rotate about their respective pivots 23 and 27 in tandem, with the footrest 25 being horizontal when the seat pan 21 is horizontal, and is folded away vertically adjacent the rear frame 11 when the seat pan 21 is folded away. Two arms rests 41 extend forward from the rear frame 11, one from each side 15. The arm rests 41 are supported on side frames 43. Each side frame 43 comprises a vertical section 45 and a horizontal section 47 extending from the top of the vertical section 45 to the sides 15 of rear frame 11. The arms rests 41 are mounted on the horizontal sections 47 which are spaced apart to allow the seat pan 21 freely to rotate between them and are set at a height with respect to the seat pan 21 to provide comfortable arm rests for a spectator seating on the seat pan 21. The side frames 43 provide a degree of containment for a spectator who is standing in the space which would be occupied by the seat pan, when in its horizontal position.

The bottom of each side member 15 of the rear frame 11 and the bottom of a vertical section 45 of the side frames 43 are welded to a base plate 49, which can be bolted to the top surface of a step 5. The bolts can be undone to allow the seat unit 4 to be moved or replaced.

As an alternative to bolting the base onto the top surface of the step on which the seat unit 4 is mounted, the side members 15 can be bolted directly onto the riser behind the infill unit. The bolts can be undone to allow the seat unit 4 to be moved or replaced.

Ideally the height of the seat pan 21 when horizontal is between 45 and 85 cms above the floor of the row on which it is installed.

When the seat pan is in use the footrest 25 act as a foot support for a spectator sitting on the seat pan, with this in mind, the seat pan frame pivots 23 and footrest pivots 27 should be placed so that the tops of the seat pan and the footrest are separated by between 40 cm and 55 cm.

Figure 8:
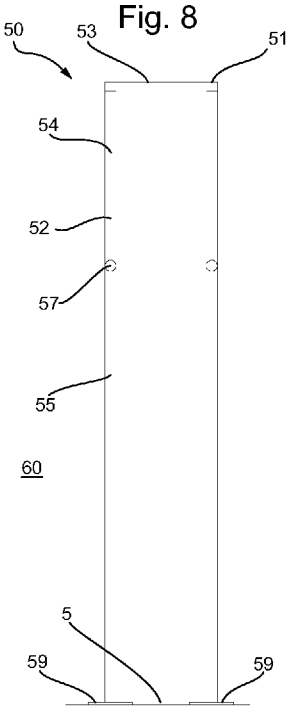
FIG. 8 shows a front view of the infill frame installed at each end of the off-set seating row of FIG. 1.
Figure 9:
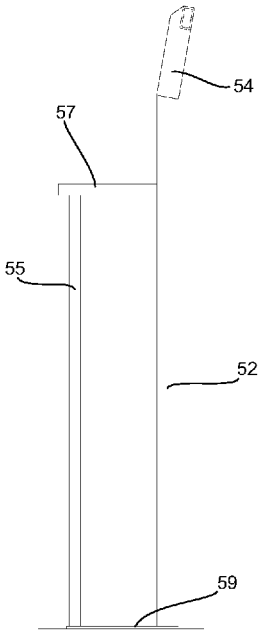
FIG. 9 shows the side elevation of FIG. 8 infill frame providing additional hand holds in the radial gangways.
Figure 10:
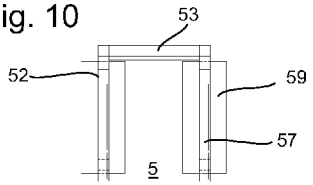
FIG. 10 shows the plan view of the infill frame of FIGS. 8 and 9.

In FIGS. 8 to 10, an infill unit 50 (as shown in FIG. 1) is illustrated. The infill unit 50 comprises a rear frame 51 with spaced apart upright side members 52, cranked 54 towards their tops, with a barrier member 53 bridging between the side members. The barrier member is at the same height as the barrier 13 in FIGS. 2 to 7.

The side member 52 are spaced apart by half the distance by which the side members 15 of the seating unit 4 shown in FIGS. 2 to 7. One side of the infill unit 9 adjoins a radial gangway 60 (see FIG. 1). On that side, a circular section horizontal member 57 is joined to a side member 52, with at its distal end a vertical member 55 extending downwards below the horizontal member. The bottom of each vertical member is mounted on a base plate 59 on which the bottom of the corresponding side member 52 is also mounted. The base plate 59 may be bolted to the step 5 on which the infill unit is mounted. On the side away from the gangway, the infill member has a common upright member with the adjoining seat and would have a frame separating it from the seat unit, which is common to the seat unit.

As an alternative to the base plate being bolted onto the step on which the infill unit 50 is mounted, the side members 52 can be bolted directly onto the riser behind the infill unit.

In the arrangement described in FIGS. 8 to 10 the circular section horizontal member 57 adjacent a gangway 60, provides a hand grab for people moving up and down that adjacent gangway 60.

In the discussion of FIGS. 2 to 10 above, the seat units 4 have been described in isolation. However, it will be understood by referring to FIG. 1 that, in a row of seat units, upright side members 15 could be, but not necessarily, common to adjacent seat units. In a row where infill units 9 are used, the upright side member 52 not adjacent a gangway also form could also, but not necessarily form an upright member 15 of the adjoining seat unit 4.

The barrier member 13 of each seat and the upright side members 15 can be fabricated from a single piece of tube, and in that case the side members would not common between adjacent seats but would be bolted or joined together in some other way in a row. Similarly the rear frame 51 including barrier member 53 can be fabricated from a single piece of tube; the side member 52 away from the gangway would not in that construction be also the upright side member of the adjacent seat unit.

Figure 11:
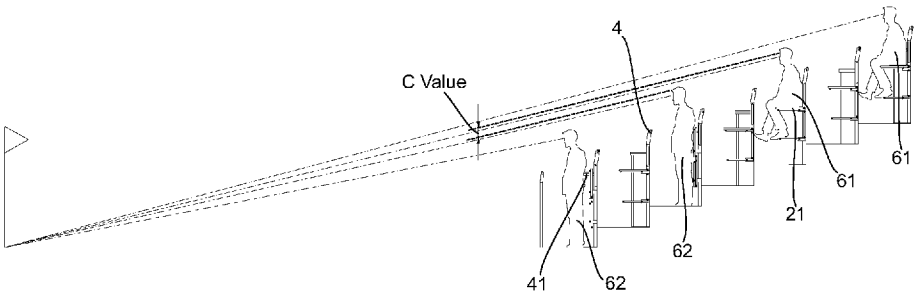
FIG. 11 shows rows of seating units according to the invention in side view.

FIG. 11 gives an overview of the seat units 4 deployed in a venue with some being used for seating and others, with their seat pans 21 folded being used as standing space. As in FIG. 1 the seat units in alternate rows are off-set to improve the quality of the spectator sightline over spectators located two rows in front looking towards a focal point which in the case of football and rugby events is either one of the touch or goal lines. This sightline is known as the C Value. Notwithstanding that some spectators 62 are standing all those seated 61 have a good a view of the activity in the venue as those standing. Those spectators standing in the seat units have sideways movement restricted by the arm rests 41.

The seat units 4 as described are between 45 cm and 60 cm inclusive wide.

Figure 12:
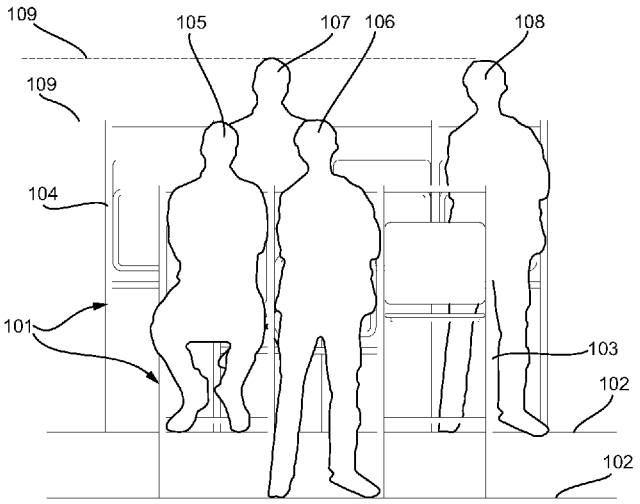
FIG. 12 shows a front view of a second example of seating units according to the invention.

In FIG. 12 shows a number of seat units 101 mounted on steps 102 of a venue. The seat units 101 are of a second example of the invention and are arranged in rows (two only are shown row 103 and a row behind 104, but normally the venue will contain multiple rows. There are some seated spectators 105 in row 103 and 107 in row 104, and other standing spectators 106 in row 103 and 108 in row 104. As can be seen in FIG. 12 the construction of the seat units is such as to bring the head heights 109 of both the seated spectators 105 and 107 and the standing spectators 106 and 108 roughly in line on each row those in the row behind 104 being able to see over those in the row in front 103 whether they are seated or standing.

As in the earlier example, the seat units in alternate rows are off-set to improve the quality of the spectator sightline over spectators located two rows in front looking towards a focal point. The principles are again as illustrated in FIG. 11.

Figure 13:
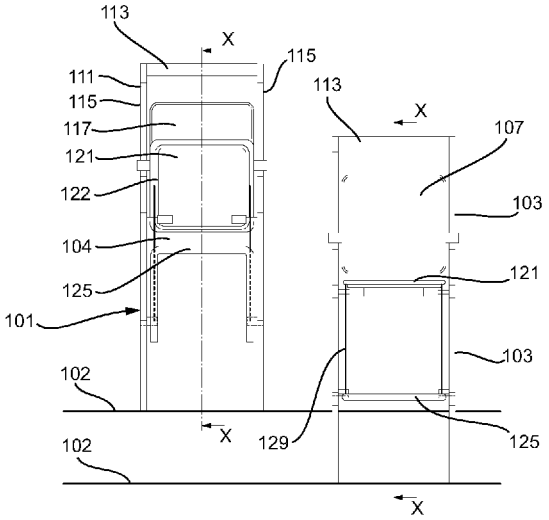
FIG. 13 shows a front view of an individual seating unit shown in FIG. 12.
Figure 14:
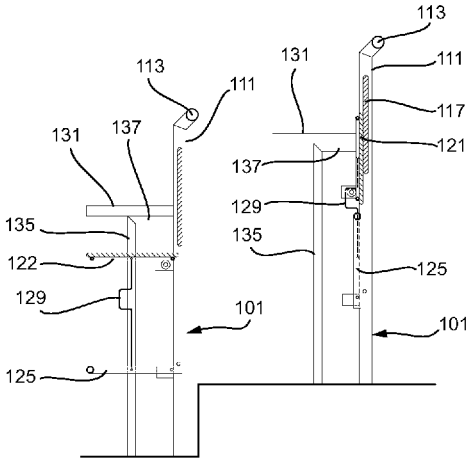
FIG. 14 shows a vertical section on the line X-X of FIG. 13.

FIGS. 13 and 14 show the general construction of an exemplary seat unit of FIG. 12. The seat unit mounted on the upper row 104 (left in FIG. 13) has the seat pan 121 folded whereas the seat unit on the lower row 103 (right in FIG. 12) has the seat pan 121 horizontal for a spectator to sit on. The seat unit 101 has a rear frame 111. A fixed back support 117 is mounted on the rear frame 111.

Figure 15:
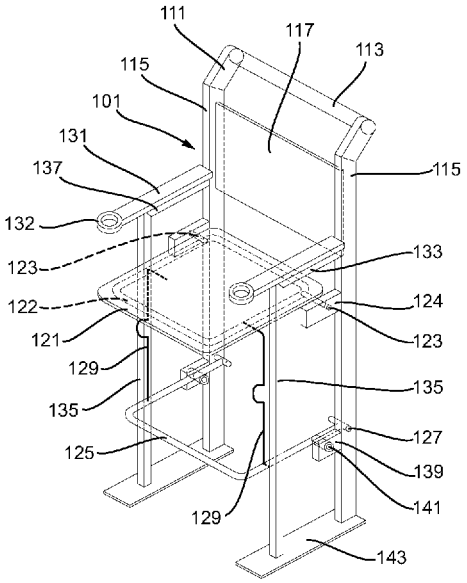
FIG. 15 shows a detail perspective view of a seating unit according to the invention with the seat pan horizontal as in use.

In FIG. 15 a guardrail 113 or transverse barrier member is set at a height H of 1.1 m above the top of the step of the row behind the seat to prevent spectators in the row behind falling from height.

As riser heights may vary, the overall height of the rear frame from the row that it is installed on may vary (i.e. guardrail 113 height of 1.1 m plus the height of the riser).

The seat pan 121 is pivotally mounted with respect to the rear frame 111. In FIG. 14, it can be seen that the seat pan 121 extends horizontally from the rear frame 111 when the seat pan is to be used but which pivots and rests against the back support 117 and rear frame 111 when not in use.

A footrest 125 pivotally on the rear frame 111 below the seat pan 121. A single or pair of connecting rods 129 (best seen in FIGS. 15 and 16) links from the seat pan mounting frame 122 beneath the seat pan 121 to footrest and is pivotally mounted with respect to the seat pan 121 and on footrest 125 so that the seat pan 121 and footrest 125 rotate about their respective pivots 123 and 127 in tandem, with the footrest 125 being horizontal when the seat pan 121 is horizontal, and is folded away against the rear frame 111 when the seat pan is folded away.

Two arms rests 131 extend forward from the rear frame 111, one from each side 115. The arm rest are supported on side frames 133.

The side frames provide a degree of containment for spectators standing in the space of the seat pan 121 when it is folded against the rear frame 111.

The arm rests 131 and the side frame 133 are spaced apart to allow the seat pan 121 freely to pivot between them, and are set at a height with respect to the seat pan 121 to provide comfortable arm rests for a spectators seating on the seat pant 21.

Figure 16:
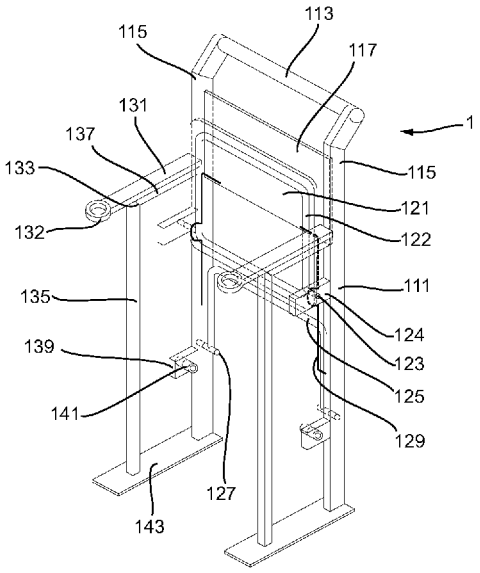
FIG. 16 is a similar perspective view to FIG. 3A but with the seat pan folded back against the rear frame allowing a spectator to stand in the space previously occupied by the seat pan.

FIGS. 15 and 16 show the seat units of FIGS. 13 and 14 in greater detail. In FIG. 15 the seat pan is horizontal ready for a spectator to sit on it, and in FIG. 16 it is folded back against the rear frame 111.

The rear frame 111 comprises a top rail 113 acting as a guard rail as necessary for spectators passing or standing or dancing behind the seat unit and link side members 5, which are generally vertical, but cranked slightly rearwards near their tops where the top rail 113 joins the side members 115 so that spectators behind holding or standing in front of the guard rail 113 and are clear of spectators sittings in the seat unit.

The back support 117 is mounted in the rear frame in a position to support the back of a spectator sitting on the seat pan 121.

Seat pan 121 is mounted on a square frame 122 with rounded corners. Seat pan pivots 123 pass into the frame 12. The seat pan pivots 123 themselves are mounted in pivot blocks 124 on extending forwards one from each side of the side members 115 of rear frame 111, such that the seat pan 121 will extend forwards horizontally from the rear frame 111 when the seat pan is to be used (FIG. 15) but which pivots against the rear frame 111 when not in use (FIG. 16). The weight of the seat is borne on seat supports 140 extending laterally from pivot blocks 4.

A footrest 125 is mounted on a pair of opposed pivots 127 mounted in footrest pivot blocks 126 on the side members 115 below the pivot blocks 124. The seat is prevented from rotating past the horizontal point by stops 141 located on the sides 115 of the rear frame. Two connecting rods 129 are pivotally mounted in apertures 128 on opposite sides of the seat pan frame 122 and in apertures 130 on opposite sides of footrest 125. The connecting rods 129 ensure that the seat pan 121 and the footrest 125 rotate about their respective pivots 123 and 127 in tandem, with the footrest 125 being horizontal when the seat pan 121 is horizontal, and is folded away against the rear frame 111 when the seat pan is folded away. The pivot apertures 128 and 130 are best located half way between the front and back of the seat pan and footrest. Two arms rests 131 extend forward from the rear frame 111, one from each side 115. The arm rests may be provided with liquid container holders 132. The arm rests 131 are supported on side frames 133. Each side frame comprises a vertical member 135 and a horizontal arm rest supports 137 extending from the top of vertical; from the tops of poles 135 to the sides 115 of rear frame 111. The arms rests 131 and their supports 137 are spaced apart to allow the seat pan 121 freely to pivot between them and are set at a height with respect to the seat pan 121 to provide comfortable arm rests for a spectator seating on the seat pan 121.

The side frames 133 provide a degree of containment for a spectator who is standing in the space which would be occupied by the seat pan, when in its horizontal position.

The bottom of each side member 115 of the rear frame 111 and the bottom of a vertical member 135 of the side frames 133 are welded to a base plate 139, which can be bolted or otherwise fixed to the top surface of a step 2. The bolts can be undone to allow the seat unit to be moved or replaced.

Ideally the height of the seat pan when horizontal is between 40 and 85 cms above the row on which it is installed.

When the seat pan is in use the footrest 125 can act as a foot support for a spectator sitting on the seat pan, with this in mind, the pivots 123 and 127 should be placed so that the tops of the seat pan and the footrest are separated by between 40 cm and 55 cm.

Figure 17:
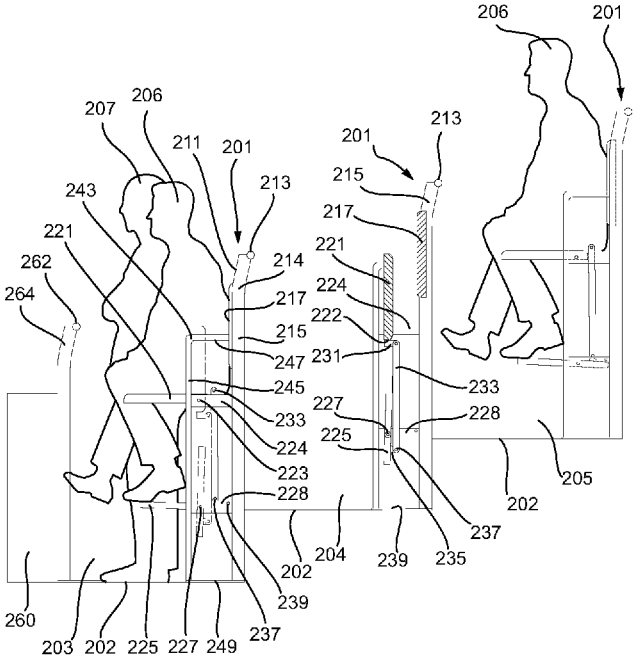
FIG. 17 shows a further example of a seat unit according to the invention.

A further example of a seat unit 201 according to the invention is shown in FIG. 17;

The units 201 are mounted on terracing 202 behind wall 260 guard rail 262 mounted on a frame 264 fixed to the wall, the wall 260 being between the front row of seat units and the area in front of the terracing.

The seat units 201 are arranged in rows 203, 204 and 205 etc. on the terracing. Row 203 is offset from rows 202 and 204 and for that reason the seat unit in row 203 is shown in vertical section.

The seat unit 201 has a rear frame 211 having spaced apart side members 215. A fixed back support 217 is mounted on each of the side members 215 the rear frame 211.

A barrier member 213 is fixed between the side members 215 of the rear frame 211 with the height of the top of the transverse barrier member 213 determined as in the earlier examples.

The guard rail 262 and barrier member 213 are generally set at a height of 1.1 metres above the level of the terracing behind the guard rail or barrier member concerned The barrier member 213 and side members 215 can be made from one piece of bent tube, or bolted or welded together. A seat pan 221 is mounted on a seat pan frame 222, a footrest 225 is pivotally mounted below the seat pan and a link bar 229 connects the seat pan frame 222 to the foot rest 225 so that the seat pan and foot rest rotate together from a closed position to an open position and vice versa. The seat pan 221 and footrest 225 project forwards from the rear of the seat unit when the seat pan 221 is in use (as in FIG. 17A) but rotate to a vertical position when not in use as in FIG. 17B. The position of the back support 217 mounting on the rear frame is such that the back support 217 will generally support the back of a spectator 206 sitting on the seat pan 221.

A rearward directed bend or crank 214 is provided in the side frames 215 towards their tops to ensure that the barrier 213 is clear of the head of any person seated on the seat pan 221.

A side frame 243 is provided either side of the seat pan 221 and footrest 225. Each side frame 243 comprises a vertical section 245 and a horizontal section 247, the horizontal section being at a convenient height to act as an arm rest for a person 205 seated in the unit. The horizontal section 247 is welded or otherwise connected to a side member 215 of the rear frame 211. The bottom of the vertical section 245 and the corresponding side member 215 are welded or otherwise joined to a footplate 249 which may be bolted down.

A horizontal seat pan mounting member 224 extends between each side member 215 and the corresponding vertical section 245 of side frame 243. A horizontal footrest mounting member 228 extends between each side member 215 and the corresponding vertical section 245 of side frame 243 below the seat pan mounting member.

A seat pan pivot 223 is provided in the seat pan mounting member 224, approximately three quarters of the way between the side frame 215 and the vertical section 245. A seat pan pivot 227 is provided in the seat pan mounting member 228, approximately three quarters of the way between the side frame 215 and the vertical section 245. Pivots 223 and 227 are separated vertically by 40 cm and 55 cm Seat pan frame 222 is extended with a section 231 at right angles to the remainder of the frame. A pivot 233 is provided in this section 231 on which one end of the link bar 229 is pivotally mounted. Footrest 225 has a pair of upstanding portions 235 in which pivots 237 are provided on which the other end of ink bar 229 is mounted.

Pivots 223 extend into the seat pan frame 222, allowing the seat pan to rotate about the seat pan mounting members 224. Pivots 237 extend into the footrest 225 allowing the seat pan to rotate about the footrest mounting members 228.

A stop pin 239 is directed inward from each footrest mounting member near the side members 215, to sop further rotation of the footrest and thus the seat pad when they reach their substantially horizontal in use positions.

It can be seen that the design in FIG. 17 allows the seat pan 221 and footrest 225 to rotate from a substantially vertical position to a substantially horizontal position or vice versa in tandem. The seated spectators 206 and standing spectators have an equally clear view of action taking place beyond the wall 260.

Figure 18A:
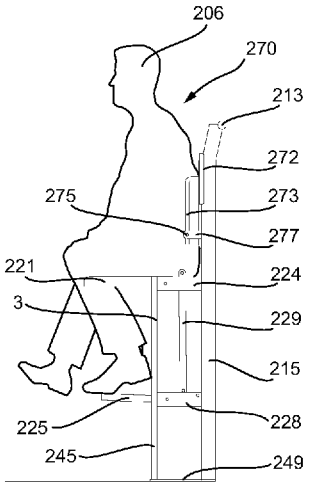
FIGS. 18A to 18C show easy access seating units allowing individuals with impaired mobility to be accommodated within venues using seat units according to the invention.
Figure 18B:
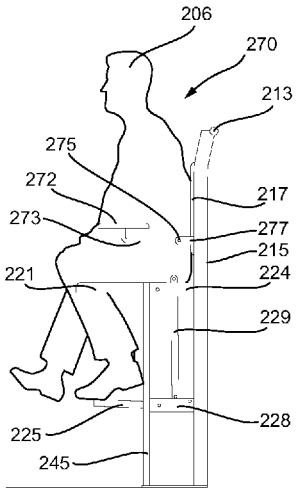

In FIGS. 18A and 18B, a seat unit 270 for use by people who have less than complete mobility needing easier access to the seat units than the designs discussed in FIGS. 1 to 17. In FIGS. 18A and 18B, the seat unit 270 is similar to that shown as 201 in FIG. 17, save that the horizontal member 247 is omitted and the vertical member 245 is truncated at the horizontal seat pan mounting member 224. Thus the side frame 243 comprises the vertical member 245, the horizontal seat pan mounting member 224, with the horizontal footrest mounting member spanning between side member 215 and the vertical member 245. The mechanism linking the seat pan and the foot rest remains exactly as shown in FIG. 17 and is not described again. An arm rest 272 is mounted on a bracket 273, which rotates about a pivot 275 mounted on a lug 277 extending forward from the side member 215. A stop prevents rotation of the arm rest to below the horizontal. To enable access to the seat unit, the arm rest is rotated to a vertical portion as shown in FIG. 17A, but when a spectator 206 is seated on the seat pan 221, the arm rest is rotated to a horizontal position as shown in FIG. 18B.

Figure 18C:
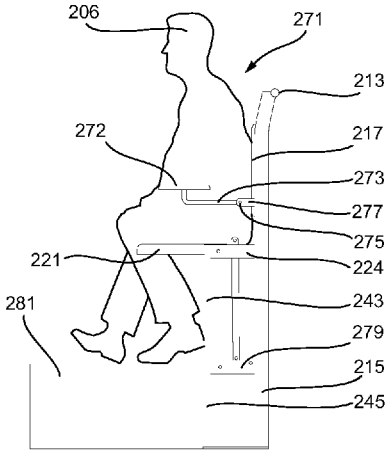

In FIG. 18C a seat unit design, which is capable of being intermingled with normal seat units according to the invention, is shown n FIG. 18C. Superficially the seat unit 271 is like that labelled 270 in FIGS. 18A and 18B. However, the foot rest 225 and the link bar 229 are omitted with the seat pan mounting member 228, replaced by a plain horizontal member 279. Conceivably the horizontal member 279 might be omitted altogether, but the seat unit would lose rigidity. A platform 281 is provided in the space between the side frames 243, and extends forward to the whole area in front of the seat unit 271. Access to the platform is by steps or a ramp to the side. The top of the platform 281 is set at the same height of the footrests on seating units around the seating unit 271.

Wheelchair users can also be accommodated within a venue using seat units according to the invention by providing a tier within the tiers of the venue, whose height is such that the eye level of a wheelchair user conforms to the c-value as discussed in relation to FIG. 11.

Although the invention has been described with reference to particular examples, variations on the specific implementation described are possible without departing from the spirit of the invention.

In the description and claims the word "step" encompasses tiers and levels stacked one above another, likewise "stepped" means having steps, tiers of stacked levels; "riser" is the vertical part of a step and "tread" is the level part of a step on which the seat units are mounted.

Further details concerning the requirements for safety in England and Wales at sports ground, and design criteria for seating and standing space, is set out in the Guide to Safety at Sports grounds 5th Edition published by the Department of Culture Media and Sport [2008]—the so called "Green Guide". Installation of seating units according to the invention in England and Wales would need to be in compliance with that Guide. It is expected that a 6th edition of the Green Guide will be issued in 2018.

Throughout the seat frame and its fixings are designed to withstand forces such as horizontal imposed being applied to the guard rail simultaneously with spectators sitting on the seats.

Although the descriptions in FIGS. 1 to 18 are of seating units installed in a tiered or stepped venue, the principles described are equally applicable to a flat venue save that there will be no risers or steps. References to the riser or steps in the description would be replaced by the references to the surface on which a seat unit is mounted. Where the height of the riser or step is mentioned this would be zero.

Employing seating units of the kind described, when females are seated the average eye-height difference between standing or seated males and seated females is substantially reduced, meaning that females have a substantially improved view compared to standing.

The seat units described in the figures have a guardrail or transverse barrier member 13,113 between the spaced apart members above and behind the back support. However, in some situations, for example where the seat unit is installed, for example, where there is a low risk of persistent standing occurring, immediately in front of a wall or in other situations where a person will not stand or pass behind the seat unit, this can be omitted.

The invention claimed is:

1. A seat unit to be mounted on a surface of a viewing area of a venue comprising:

a rear frame comprising two spaced apart upright members having a fixed back support mounted thereon and a transverse barrier member between the spaced apart members, said transverse barrier member being above and behind the back support;

a fold away seat pan pivotally mounted with respect to the rear frame on a pair of seat pan pivots, said seat pan extending substantially forward of the rear frame when ready for use but vertical adjacent the rear frame when not in use;

a footrest pivotally mounted on footrest pivots below the seat pan pivots, the footrest moving in tandem with the seat pan from an open position substantially parallel to the seat pan when the seat pan is in use to a vertical position against the rear frame when the seat pan is not in use; and two side frames, one each side of side the seat pan;

the spaced apart upright members being fixedly attachable to the surface of the viewing area.

2. A seat unit according to claim 1 which the transverse barrier member comprises a guardrail.

3. A seat unit according to claim 1 in which the side frames restrict side movement of a spectator standing in the space of the seat pan when the seat pan is vertical.

4. A seat unit according to claim 1 in which the seat pan is mounted on a seat pan frame with which the seat pan pivots engage.

5. A seat unit according to claim 1 in which the seat pan frame and footrest are connected by one or more linkage arms, rods, bars, cables, wires or coil springs to transmitting rotation of one of the seat pan or foot rest is transmitted to the other of the footrest and seat pan.

6. A seat unit according to claim 1 in which the seat pan pivots are in seat pan pivot blocks projecting forward from the rear frame.

7. A seat unit according to claim 6 in which lugs extending laterally from the seat pan frame engage against the underneath of the seat pan pivot blocks when the seat pan is horizontal.

8. A seat unit according to claim 1 in which the footrest pivots are in footrest pivot blocks projecting forward of the rear frame.

9. A seat unit according to claim 1 an arm rest pivotal with respect to the rear frame.

10. A seat unit according to claim 1 in which the spaced apart upright members are cranked towards their tops.

11. A seat unit according to claim 1 is in a row off-set by 50% of a seat width from a row in front or a row behind in which the row containing the seat unit concerned has an infill frame at one or both ends of the row, said infill frame being half the width of a seat unit.

12. A seat unit according to claim 11 in which the infill frame is adjacent to a radial gangway in a stepped seating venue said infill frame having a horizontal member acting as a hand hold for the radial gangway.

13. A seat unit according to claim 11 interspersed with other seat units having seat pans at the same height as the seat pan of the said unit, but said other units being adapted to accommodate persons of restricted mobility.

* * * * *